US006128790A

United States Patent [19]

Brayda Di Soleto

[11] Patent Number: 6,128,790

[45] Date of Patent: Oct. 10, 2000

[54] SANITARY APPARATUS FOR ASSISTING INFIRM PERSONS, IN PARTICULAR FOR AIDING IN PERFORMING PHYSIOLOGICAL FUNCTIONS

[75] Inventor: Guglielmo Brayda Di Soleto, Bologna, Italy

[73] Assignee: Desstone S.r.l., Bologna, Italy

[21] Appl. No.: 09/194,518

[22] PCT Filed: Jun. 3, 1997

[86] PCT No.: PCT/IT97/00125

§ 371 Date: Nov. 25, 1998

§ 102(e) Date: Nov. 25, 1998

[87] PCT Pub. No.: WO97/47267

PCT Pub. Date: Dec. 18, 1997

[30] Foreign Application Priority Data

Jun. 14, 1996 [IT] Italy ..... BO96A0329

[51] Int. Cl.[7] ..... A47K 11/06

[52] U.S. Cl. ..... 4/484; 4/480; 4/482

[58] Field of Search ..... 4/484, 479, 480, 4/482, 483

[56] References Cited

U.S. PATENT DOCUMENTS

| | | | |
|---|---|---|---|
| 3,401,409 | 9/1968 | Ekrut | 4/484 |
| 4,571,759 | 2/1986 | Sasaki et al. | 4/480 |
| 5,062,165 | 11/1991 | Kerr | 4/483 |
| 5,189,745 | 3/1993 | Workman et al. | 4/480 |
| 5,381,573 | 1/1995 | MacSanz | 4/480 |

FOREIGN PATENT DOCUMENTS

| | | |
|---|---|---|
| 1231364 | 5/1989 | Italy . |

*Primary Examiner*—David J. Walczak
*Attorney, Agent, or Firm*—Fay, Sharpe, Fagan, Minnich & McKee, LLP

[57] ABSTRACT

A sanitary apparatus for assisting infirm persons, in particular for aiding in performing physiological functions. The apparatus includes a support structure, an anatomic support element defining a support area, and a moving mechanism for translating at least the anatomic support element between at least two positions, a first lowered or stand-by position and a second raised position suitable for performing physiological functions. The apparatus further includes a cleansing system and a ventilation system that act in correspondence with the support area to deliver a cleansing liquid and circulating air in the area, respectively. The apparatus is fitted with a container support system for supporting a container destined to collect the residues of the physiological functions and/or of the cleansing liquid. A mechanism is provided for closing and sealing the container to isolate its contents.

18 Claims, 6 Drawing Sheets

L
L
L
2
11
12
16
7
6
8
17
19
61
62
63
64
65
66
71
72
73
74
75
76
X
X'
81
82
83
84

SANITARY APPARATUS FOR ASSISTING INFIRM PERSONS, IN PARTICULAR FOR AIDING IN PERFORMING PHYSIOLOGICAL FUNCTIONS

TECHNICAL FIELD

The present invention relates to a sanitary apparatus for assisting infirm persons, in particular for aiding in performing physiological functions.

Currently, to assist infirm persons who are bedridden, or anyway not independent with regard to ambulation and/or the erect posture, essentially manual procedures are carried out, particularly in regard to aiding in performing physiological functions, such as operations connected to defecation, to urination and to the subsequent cleansing operations.

Manually performed procedures can be found annoying both by the person being assisted and by the paramedic personnel rendering assistance.

To allow infirm persons to satisfy their physiological needs without a totally manual intervention, apparatuses have been designed for the collection of physiological waste, to be associated to beds, armchairs and similar structures for patients.

BACKGROUND ART

In the prior art, patent IT-1.231.364, provided an apparatus for the collection of patients' physiological waste. The document describes an apparatus able to allow infirm persons, forced to a total or partial immobility, to satisfy their physiological needs. The apparatus essentially comprises a structure fitted with a vertically movable anatomic element to aid in supporting a patient, means able to cleanse and dry the patient and a container for collecting physiological waste. This apparatus thus is able to facilitate the aforesaid physiological operations, collecting the waste in the appropriate container.

DISCLOSURE OF THE INVENTION

The invention constituting the object of the present patent application intends to solve the problem related to infirm persons' defecation and urination, and to their cleansing, washing and drying, providing an apparatus able to aid in performing physiological functions collecting the waste in containers which are preferably single-use and sealable.

In this way, on one hand, the apparatus allows to perform physiological functions and the subsequent cleansing operations, while on the other hand it enables to isolate the waste resulting from the aforesaid operations, eliminating the possibility of contact with that waste, facilitating its disposal. These characteristics are extremely important in the context of the current regulations for handling hospital waste and from the point of view of improving patients' living conditions as weel as paramedic personnel's working conditions.

The sanitary apparatus for assisting infirm personnel is of the type comprising a support structure, an anatomic support element, motion means able to translate vertically at least the anatomic support element between at least two positions, cleansing means and ventilation means able, respectively, to deliver a cleansing liquid and to produce an air circulation; the sanitary apparatus is characterised in that it is provided with means for supporting a container, destined to collect the waste resulting from physiological functions and/or the cleansing liquid, in correspondence with said support area or in any case in an area connected thereto and with means able to close the container, in such a way as hermetically to isolate its contents.

Using as a receptacle a bag made of heat-sealable material, the apparatus can comprise closure means constituted by binding elements for sealing the content of the bag.

The motion of the means for supporting and closing the container can advantageously be commanded by means of cam means, i-e. guided by means of simple design and able to guarantee a remarkable reliability, thanks to the absence of complex motion mechanisms.

Moreover, the various procedures of the apparatus can be managed partly or totally by electronic command and control means able to make the various components of the apparatus perform a succession of operating phases, controlled in an essentially automatic manner.

The technical characteristics of the invention, according to the aforesaid purposes, can clearly be seen from the content of the claims reported below and its advantages shall be made more evident in the detailed description that follows, made with reference to the attached drawings, which show an embodiment provided purely by way of non limiting example, wherein:

FIGS. 1, 1A and 2 relate to front schematic views, with some parts removed to highlight others and with a detail in enlarged scale, of an embodiment of the subject invention, in different positions of operation with one of the positions shown in phantom lines in FIG. 1;

Figures 1, 2:
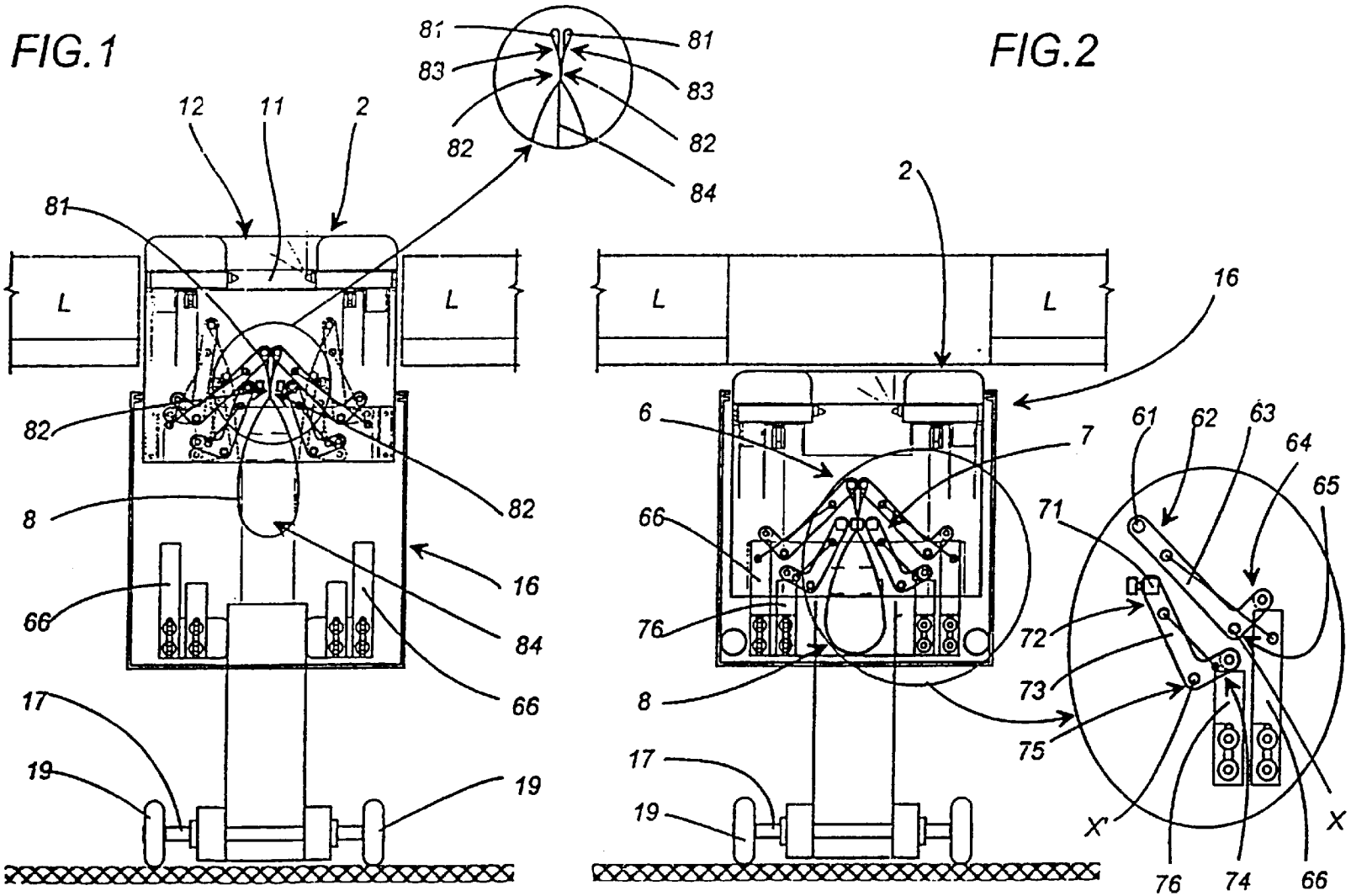

The apparatus constituting the object of the invention, indicated as 1 in its entirety, can be used to assist infirm persons, in particular to aid them in performing physiological functions and in the various operations connected thereto.

The sanitary apparatus 1 essentially comprises a support structure 10 fitted with a plurality of devices of various types described hereafter.

The support structure 10 can be fitted with wheels allowing it to be moved about. In particular, in the example shown, the structure 10 comprises a pair of front wheels 19 which can rotate around a horizontal axle 17 and a pair of swivelling rear wheels 18, hinged around their respective vertical Y axes.

The support structure 10 presents, at its top, an opening 11, where an anatomic support element 2 is fitted to define a support area 12. This support area is, in practice, the area of the apparatus that is directly involved with supporting a person requiring assistance and that is used for performing the various hygienic-sanitary operations described hereafter.

The anatomic support element 2, and a whole portion 16 of the apparatus 1 can be moved vertically thanks to the presence of motion means 3, located on the structure 10 and acting on the movable portion 16 which supports the anatomic support element 2 and other devices.

In the form of embodiment shown, the motion means 3 comprise a square tubular element 31, presented by a base 15 (or fixed portion 15) of the support structure 10, wherein is coaxially inserted a corresponding square element, presented by the movable portion 16, and an element whose extension can be varied on command such as a cylinder 33 which causes the movable portion 16 and the anatomic support element 2 to be raised or lowered.

The motion means 3 thus serve the purpose of translating vertically at least the anatomic support element 2 between at least two positions of which a first lower, or stand-by, position and a second raised position suitable for performing physiological functions. In this second position the anatomic support element reaches a suitable height with respect to a bed L in order to allow the infirm person to be supported by the anatomic support element. Obviously, bed L shall be provided with a suitable opening to allow the insertion of the anatomic support element; such opening provided on bed L shall also be present in the mattress and in the bed linen.

The support area 12 is provided with cleansing means 4 and ventilation means 5 able, respectively, to deliver a cleansing liquid and to produce an air circulation in the area.

In particular, cleansing means 4 can comprise two tanks 44 and 43 destined, respectively, to contain water and a detergent, and connected, by means of appropriate ducts on which are fitted related pumps 40 and 41, to one or more nozzles 42 so placed as to deliver liquid in the direction of the support area 12. To heat the two liquids, two resistor elements 46 and 45 can be fitted, respectively for the water and for the detergent.

The ventilation means 5 can comprise an intake fan 51 and a drying fan 52. In the embodiment shown, the intake fan 51 acts on a duct 53 presenting an intake opening 56 positioned in the support area 12 and an output opening 55 connected to the outside of the apparatus 1 and provided with filtering elements. The drying fan 52 acts on a duct 54 (which connects an external intake opening 57 and a delivery opening 58 placed on the support area 12) and acts in a direction opposite that of the intake fan 51. The flow of air inside the duct 54 is thus directed towards the support area 12 and can be heated by resistor means 59 provided on the duct 54.

Advantageously the apparatus 1 is provided with means 6 for supporting a container 8, destined to collect the waste resulting from physiological functions and/or the cleansing liquid, in correspondence with the support area 12 (or in any case in an area connected thereto) and with means 7 able to close the container 8, so as hermetically to isolate its contents.

In other words, the apparatus is provided with means able to support a container for physiological waste (possibly combined with the cleansing fluid) and to seal the same once the physiological functions have been performed.

In the example shown, the container 8 comprises a bag-shaped receptacle which can be, for instance, a bag made of single-use heat-sealable plastic material.

The bag 8 is provided with its seats or pockets located in correspondence with the first two opposed portions 81 or located in correspondence with the mouth of the bag 8 on two opposed faces 83.

The support means 6 comprise at least two support elements 61, represented by two stems 61 fitted horizontally and able to be inserted into the seats presented by bag 8 in order to support it Obviously, support elements may be differently shaped according to the corresponding shape presented by the container 8.

The support elements or stems 61 are placed on first ends 62 of first "L" shaped levers 63, with their fulcrum, in correspondence with their angular portion 65, on corresponding horizontal axes X and on whose other ends 64 contact first command rods 66, adjustable vertically.

Figure 1A:
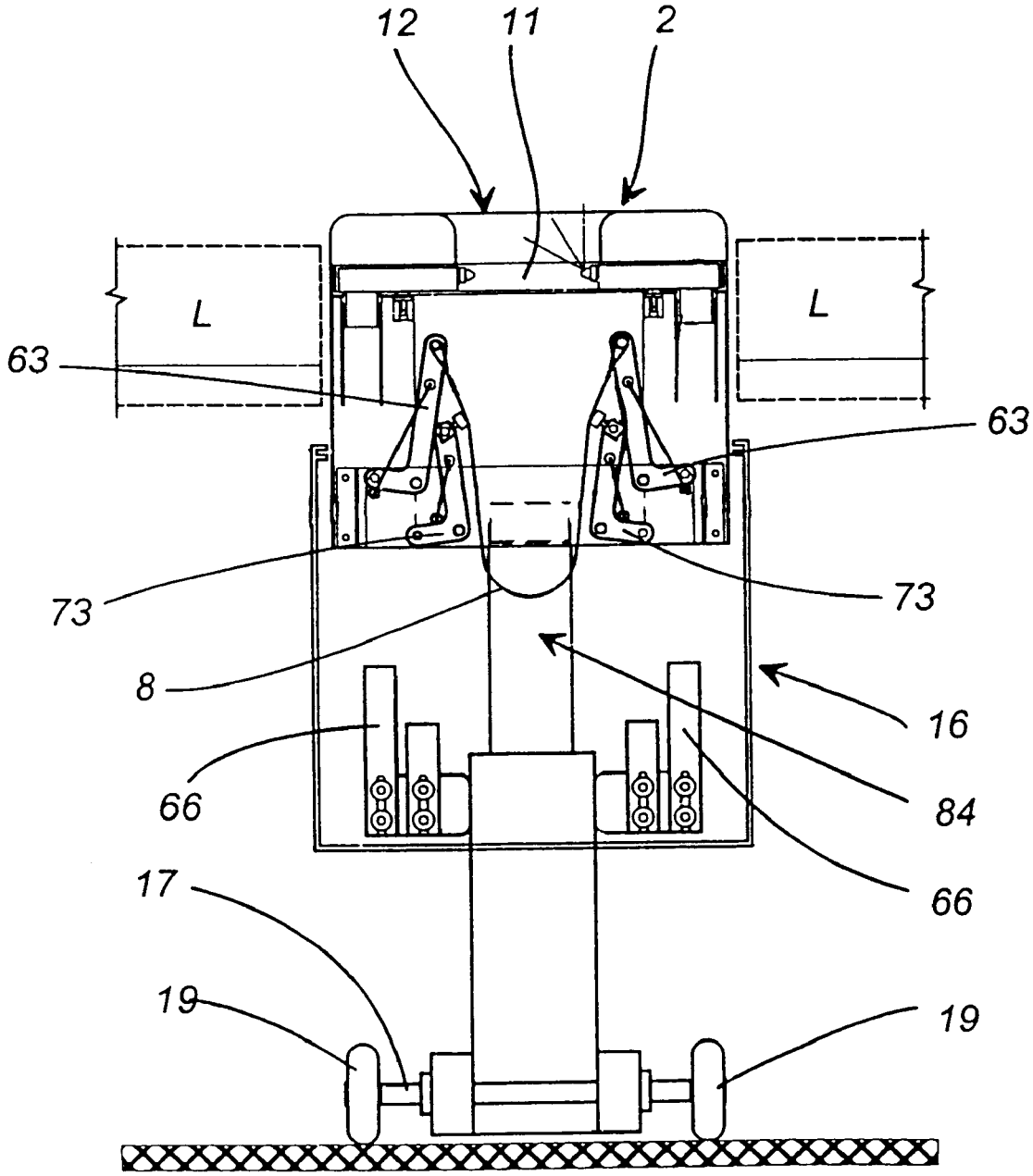
Figure 3:
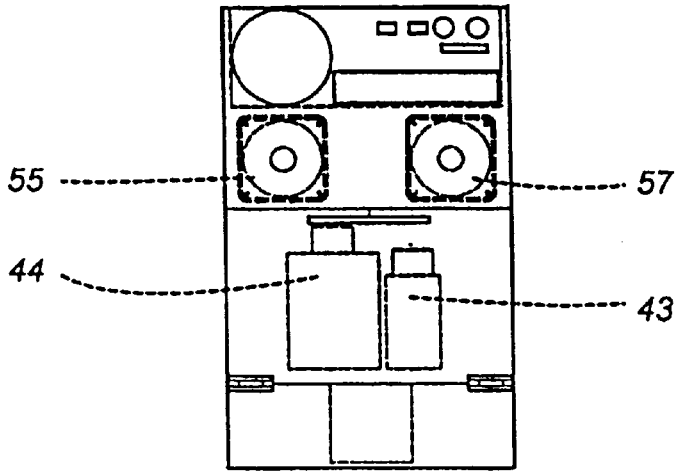
FIGS. 3 and 4 show schematically, respectively in a rear view and in a side view with some parts removed to highlight others, the embodiment as per the previous figures.

In this way, in correspondence with vertical translations relative to the rods 66 there will be rotations of the stems 61 which are led along an operating path which provides for at least two positions in which the support elements 61, together with the first opposed portions 81 of the container supported by them, are distanced respectively by a larger value so as to open the container FIG. 1A and by a smaller value so as to close it FIG. 2.

The first rods 66 can be connected to motion means 3, so that to the move, made by the anatomical support element 2, from the second raised position to the first lower position, shall correspond a move by the support elements 61, along the aforesaid operating path, from the position in which the container is open to the position in which the container is closed. In other words, when the anatomic support element 2 is at bed height, the bag 8 is open, whereas when the element is lowered (after performing the physiological functions and the related operations of cleansing, drying, etc.), the mouth of the bag 8 is closed.

As stated previously, in addition to the means 6 for supporting the bag 8, the apparatus also presents means able to close or closing means 7.

These means 7 able to close the container 8 are located below the support elements 61, i.e. they act between the mouth and the bottom of the bag 8, so as to close the bag 8 by irremovably binding the second opposed portions 82 placed below the first opposed portions 81.

If the container is a heat-sealable bag, the means 7 able to close the container can also comprise two binding elements 71 able to seal said container.

Binding elements 71 too, similarly to support elements 61, can be placed on the first ends 72 of second "L" shaped levers 73, with their fulcrum, in correspondence with their angular portion 75, on corresponding horizontal axes X' and on whose other ends 74 act second vertically adjustable command rods 76. The second command rods 76 also can be connected to the motion means, similarly to the arrangement for support means 6 and described previously.

This way of moving the supporting elements 61 and the binding elements 71 guarantees a marked reliability of the machine, thanks to the simplicity with which the motion is transmitted to such elements 61 and components 71.

The sanitary apparatus can also comprise folding components 88 acting vertically on each of the flanks 84 between the faces 83 of the container, so as to set the bag 8, before activating the closing means 7, in a configuration in which the flanks 84 are folded and interposed between the two faces drawn near each other. This fold of the bag shall preferably involve its top area, close to the mouth of the bag and not occupied by waste.

In this way the closure of the bag 8 shall be extended in its perimeter along a whole line of the bag itself, eliminating the possibility of defective closures, i.e. not complete along an entire perimeter.

The folding elements 88 can comprise, as in the embodiment shown, two levers 88 presenting two essentially vertical portions placed in correspondence with the positions occupied by the flanks of the bag 8 once the bag is borne by supporting elements 61. The levers 88 are shaped as a line broken at the bottom (i.e. they are curved with their respective concavities opposite each other and facing the area occupied by the bag) and their fulcrum is there on horizontal axes Z and connected to means 87 for transmitting a command. After activation of the means 87 for transmitting the command, i.e. after they are moved to provide a thrust or a traction of the levers 88, the latter can be drawn nearer in order to insert the flanks 84 of the bag 8 into the faces 83, for the aforementioned operations preceding closure.

To guarantee greater asepticity, the sanitary apparatus 1 can be provided with reversible means for fastening the anatomic support element 2 to the support structure 10, in order to facilitate cleaning and/or sterilisation operations on the element 2 itself which can preferably be made of autoclavable material.

Figure 5:
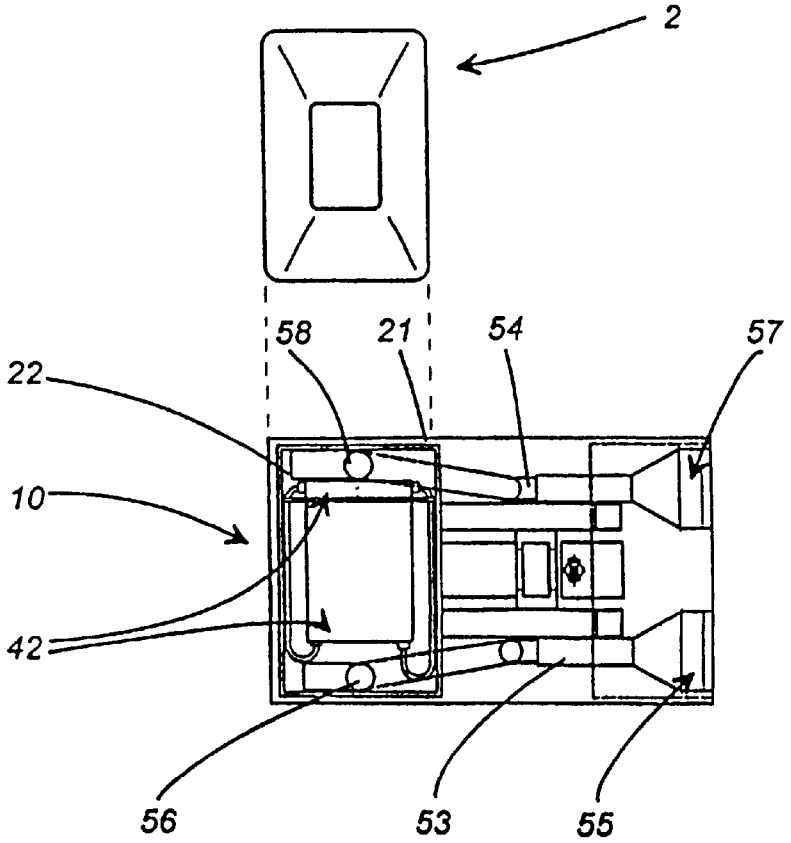
FIG. 5 shows, in a schematic top plan view with parts removed, the embodiment as per the previous figures, with some detached details of a support structure.
Figure 4:
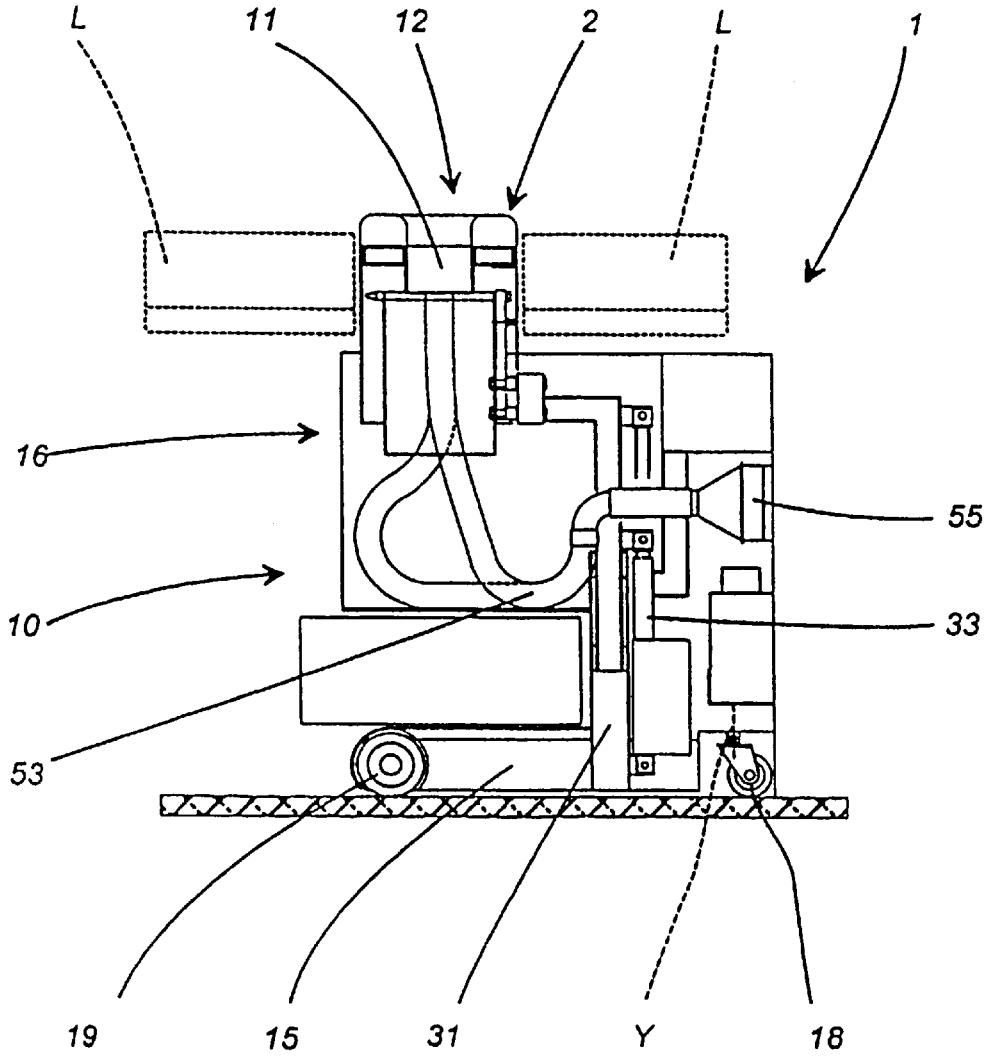
Figure 6:
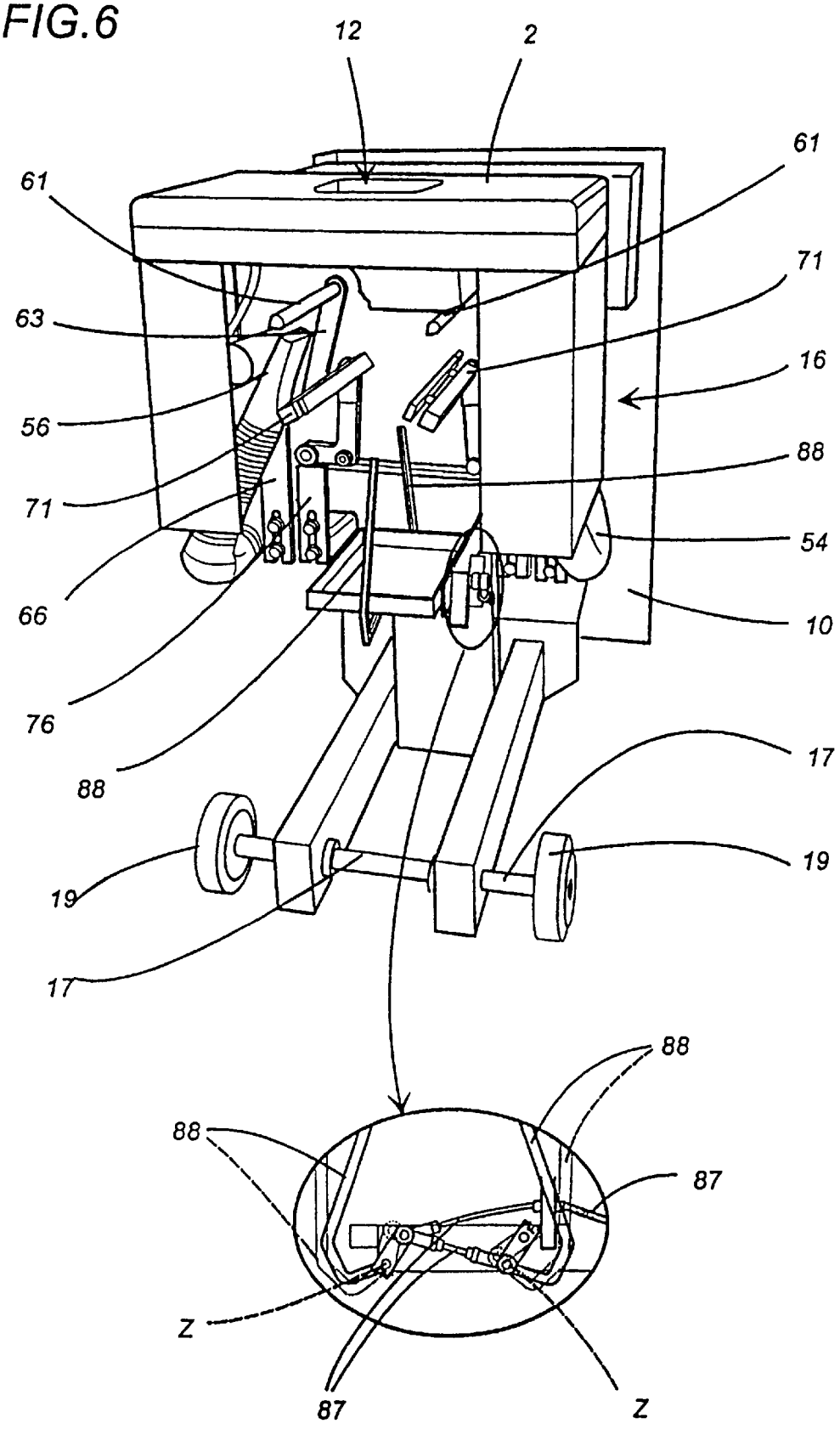
FIG. 6 shows, in a prospective schematic view, the embodiment as per the previous figures, with one detail also shown in side view for better identification.

As is best seen in FIG. 5, the structure 10 can comprise a top portion 22 on which can be inserted an intermediate element 21 able to allow connections with one or more nozzles 42 present at the output of the cleansing ducts.

On the intermediate element 21 can be fastened the anatomic support element 2: in this way, each time the apparatus 1 is used, it is possible to replace an anatomic support element 2 already used with a new, or sterilised, one.

For the operation of the various parts of the apparatus 1 an electrical power supply can be provided, for instance by means of a battery 97 which can be provided with a recharging device 98, in order for it to be recharged by connection to mains voltage.

All the various operations which the apparatus can perform may be established by means of electronic command and control means 9, preferably of the microprocessor type.

Figure 7:
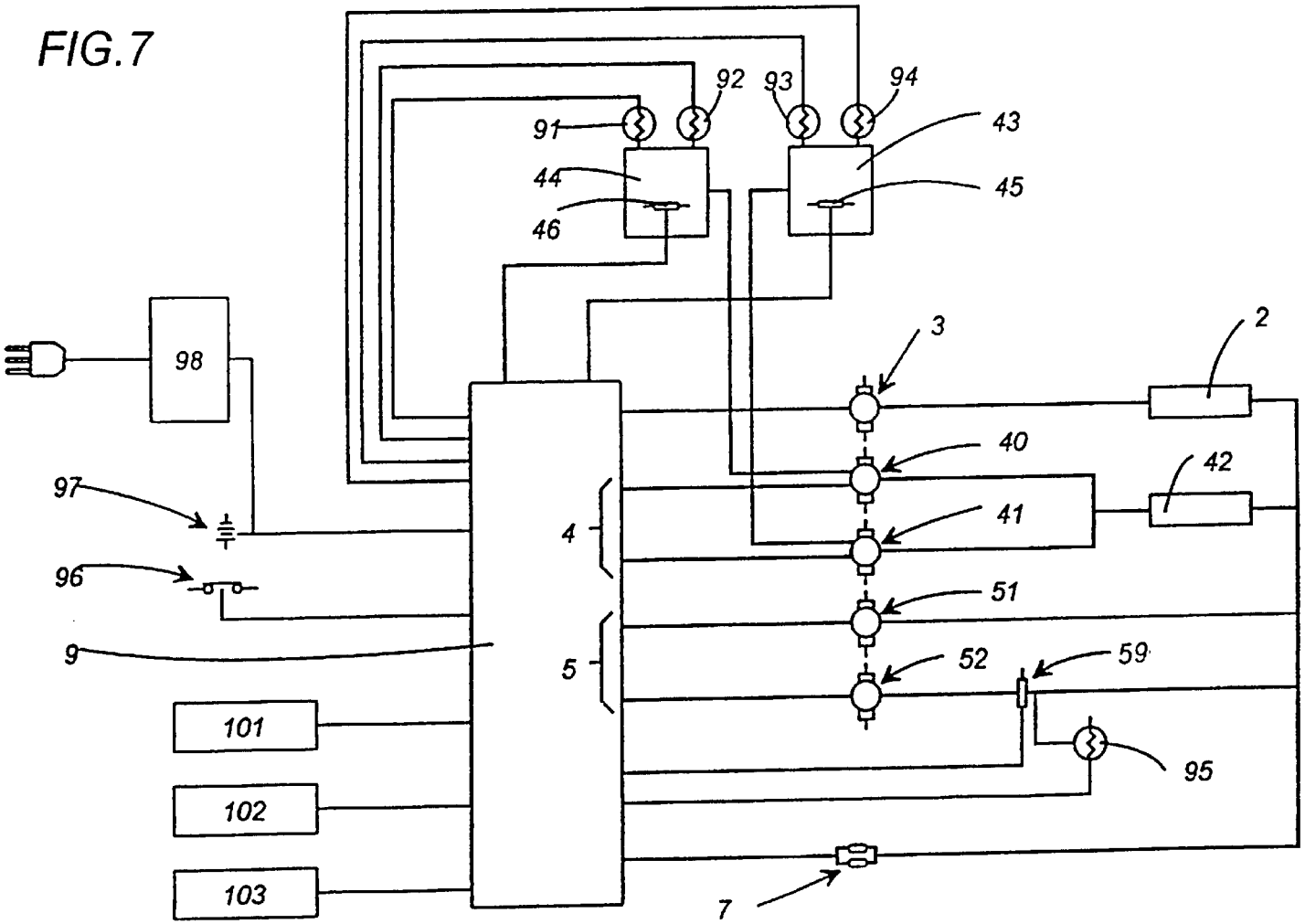
FIG. 7 is a diagram concerning the possible connections between the various component parts of an embodiment of the invention.

With reference to FIG. 7, these electronic means are connected to the motion means 3, to the cleansing means 4, to the ventilation means 5, to the supporting means 6 and to the means 7 able to close the container, in order to make the apparatus 1 perform a series of operations according to a procedure determined by an operator or by a protocol which can be stored by the electronic means 9 themselves. In other words, the various operating phases of the apparatus can be totally or partially automated and, analogously to the diagram in FIG. 7, birectional means for communicating with the apparatus can be provided, comprising, for instance, a display 101, a keyboard 102 and a remote control 103.

These bidirectional communications means can be used by an operator, such as the paramedic personnel, or directly by a patient.

The electronic means 9 act on the motion means 3 commanding the linear actuator of the cylinder 33 described above. For the proper operation of the anatomic support element 2, means 96 for sensing alignment with the bed L are provided.

The electronic means 9 can comprise a series of sensors placed in correspondence with suitable parts of the equipment to be monitored. A level sensor 91 and a temperature sensor 92, acting on the water tank 44, can be provided, as well as a level sensor 93 and a temperature sensor 94 on the detergent tank 43.

The cleansing means can also be commanded providing a connection between the electronic means 9 and the water and detergent pumps 40 and 41.

Analogously, the electronic means 9 can be connected to the intake fan 51 and to the drying fan 52, and temperature sensors 95 can be provided on resistor 57 which heats the drying air flow.

The invention thus conceived can be subject to numerous modifications and variations, without thereby departing from the scope of the inventive concept. Moreover, all components may be replaced with technically equivalent elements.

What is claimed is:

1. Sanitary apparatus for assisting infirm persons in performing physiological functions, said apparatus comprising:

a support structure presenting at its top an opening;

an anatomic support element positioned in correspondence with said opening and defining a support area;

motion means able to translate vertically at least said anatomic support element between at least two positions including a first lower stand-by position and a second raised position suitable for performing said physiological functions, wherein a corresponding part of the infirm person is able to rest on the anatomic element;

cleansing means and ventilation means positioned and acting in correspondence with said support area and adapted for respectively delivering a cleansing liquid and producing a circulation of air in the area;

support means able to support a container for the collection of at least one of residues of said physiological functions and said cleansing liquid, in correspondence with said support area; and, means for closing the container to isolate hermetically its content.

2. Sanitary apparatus according to claim 1, wherein said support means comprise at least two support elements, suited to interact with corresponding first opposed portions presented by said container and moved along an operating path which provides for at least two positions in which said support elements, together with said first opposed portions of the container supported by them, open said container and close the container, respectively.

3. Sanitary apparatus according to claim 2, wherein said support elements are fitted on first ends of first "L" shaped levers, with their fulcrum, in correspondence with their angular portion, on corresponding horizontal axes and on whose other ends act first command rods adjustable vertically, so as to lead said support elements along said operating path in correspondence with vertical relative to said first rods.

4. Sanitary apparatus according to claim 3, wherein said first command rods are operably located relative to said motion means, in such a way that a move made by said anatomic support element from the second raised position to the first lower position, corresponds a move by said support elements, along said operating path, from the position in which the container is open to the position in which the container is closed.

5. Sanitary apparatus according to claim 2, wherein said container comprises a bag-shaped receptacle provided with its own seats placed in correspondence with said first opposed container portions, and wherein said support elements comprise two stems positioned horizontally and adapted for insertion into said seats to support said container.

6. Sanitary apparatus according to claim 5, wherein said container comprises a receptacle made of heat-sealable material and wherein said means able to close the container comprise binding elements positioned below said support elements between a mouth and a bottom of said receptacle, across the receptacle itself, so as to close the receptacle by irremovably binding its two second opposed portions along a closure line positioned below said first opposed portions of the receptacle.

7. Sanitary apparatus according to claim 5, wherein said means for closing the container are fitted below said support elements between a mouth and a bottom of said container in order to close the container irremovably binding two second opposed portions of said container placed below said first opposed portions of said container.

8. Sanitary apparatus according to claim 7, wherein said seats are provided on two opposed faces of said receptacle and wherein two folding elements are provided, acting vertically on each of the flanks of the receptacle included between said faces, in order to set the receptacle itself, prior to the activation of said means able to close, in a configuration in which said flanks are folded and interposed between the two faces drawn nearer to each other.

9. Sanitary apparatus according to claim 1, wherein said container comprises a receptacle made of heat-sealable material and wherein said means able to close the container comprise binding elements able to seal the container.

10. Sanitary apparatus according to claim 1, wherein said closing means comprise two opposed linear extension elements essentially arranged horizontally and supported by first ends of second "L" shaped levers, with their fulcrum, in correspondence with their angular portion, on corresponding horizontal axes, and on whose other ends act second command rods adjustable vertically, so as to lead said opposed linear extension elements along a second operating path between a stand-by configuration in which the elements are distanced and an active configuration in which they are in contact with second opposed portions of said container to close the adjustable.

11. Sanitary apparatus according to claim 10, wherein said second command rods are operably located relative to said motion means, in such a way that a move, made by said anatomic support element, from the second raised position to the first lower position, corresponds a move by said opposed linear extension elements, along said second operating path, from the position in which the closing means are in stand-by configuration to a position in which they are in active configuration.

12. Sanitary apparatus according to claim 1, further comprising reversible means for fastening said anatomic support element to said support structure, in order to facilitate cleaning and/or sterilizing the anatomic support element.

13. Sanitary apparatus according to claim 12, wherein said anatomic support element is made of autoclavable material.

14. Sanitary apparatus according to claim 1, wherein said anatomic support element is made of autoclavable material.

15. Sanitary apparatus according to claim 1, wherein it is provided with electronic command and control means connected to said motion means, to said cleansing means, to said ventilation means, to said support means and to said means for closing the receptacle, so as to make the apparatus perform a series of operations according to a procedure determined by one of an operator and a protocol stored by the electronic means.

16. Sanitary apparatus according to claim 15, wherein said motion means comprise at least one variable extension element fitted and acting on the apparatus between a base portion and a movable portion supporting said anatomic support element and wherein said electronic command and control means are connected to sensing means able to verify the alignment of said anatomic support element with a bed to enable proper setting of a height of the apparatus for performing said physiological functions.

17. Sanitary apparatus according to claim 15, wherein said cleansing means comprise a tank to contain water, a tank to contain a detergent, respectively provided with means able to heat said water and means able to heat said detergent and on which act respectively a pump for the water and a pump for the detergent and wherein said electronic means are connected to a level sensor and to a temperature sensor acting on the water tank, to a level sensor and to a temperature sensor acting on the detergent tank, as well as to said water and detergent pumps.

18. Sanitary apparatus according to claim 15, wherein said ventilation means comprise an intake fan and a drying fan, acting respectively on an intake duct and on a drying duct, and wherein said electronic means are connected to said intake fan, to said drying fan and to said temperature sensing means provided and acting at least on said drying duct.

* * * * *